US010779667B2

(12) United States Patent
Phan

(10) Patent No.: US 10,779,667 B2
(45) Date of Patent: Sep. 22, 2020

(54) DRINKING STRAW

(71) Applicant: Pacific Market International, LLC, Seattle, WA (US)

(72) Inventor: Ping Phan, Shoreline, WA (US)

(73) Assignee: Pacific Market International, LLC, Seattle, WA (US)

( * ) Notice: Subject to any disclaimer, the term of this patent is extended or adjusted under 35 U.S.C. 154(b) by 89 days.

(21) Appl. No.: 16/181,189

(22) Filed: Nov. 5, 2018

(65) Prior Publication Data

US 2020/0138216 A1 May 7, 2020

(51) Int. Cl.
*A47G 21/18* (2006.01)

(52) U.S. Cl.
CPC ..... *A47G 21/18* (2013.01)

(58) Field of Classification Search
CPC ..... A47G 21/18
USPC ..... 239/33, 600
See application file for complete search history.

(56) References Cited

U.S. PATENT DOCUMENTS

2018/0160831 A1* 6/2018 Yoo ..... A47G 21/18
2018/0352983 A1* 12/2018 Allen ..... A47G 21/18
2019/0038058 A1* 2/2019 Abbott-Glazier ..... A47G 21/18

FOREIGN PATENT DOCUMENTS

DE 102018005018 B3 * 8/2019 ..... A47G 21/18

* cited by examiner

*Primary Examiner* — Christopher S Kim
(74) *Attorney, Agent, or Firm* — Davis Wright Tremaine LLP; George C. Rondeau, Jr.; Heather M. Colburn

(57) ABSTRACT

A drinking straw including first and second straw portions. The second straw portion is configured to be removably attachable to the first straw portion. At least a portion of a through-channel is defined between the first and second straw portions.

11 Claims, 6 Drawing Sheets

DRINKING STRAW

BACKGROUND OF THE INVENTION

Field of the Invention

The present invention is directed generally to drinking straws.

Description of the Related Art

Environmental concerns have caused many jurisdictions to ban the use of disposable drinking straws. Unfortunately, reusing currently available drinking straws is impractical because their long internal channels are difficult to clean. For example, currently available drinking straws may be cleaned by either soaking them or using a pipe cleaner to scrub their internal channels.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
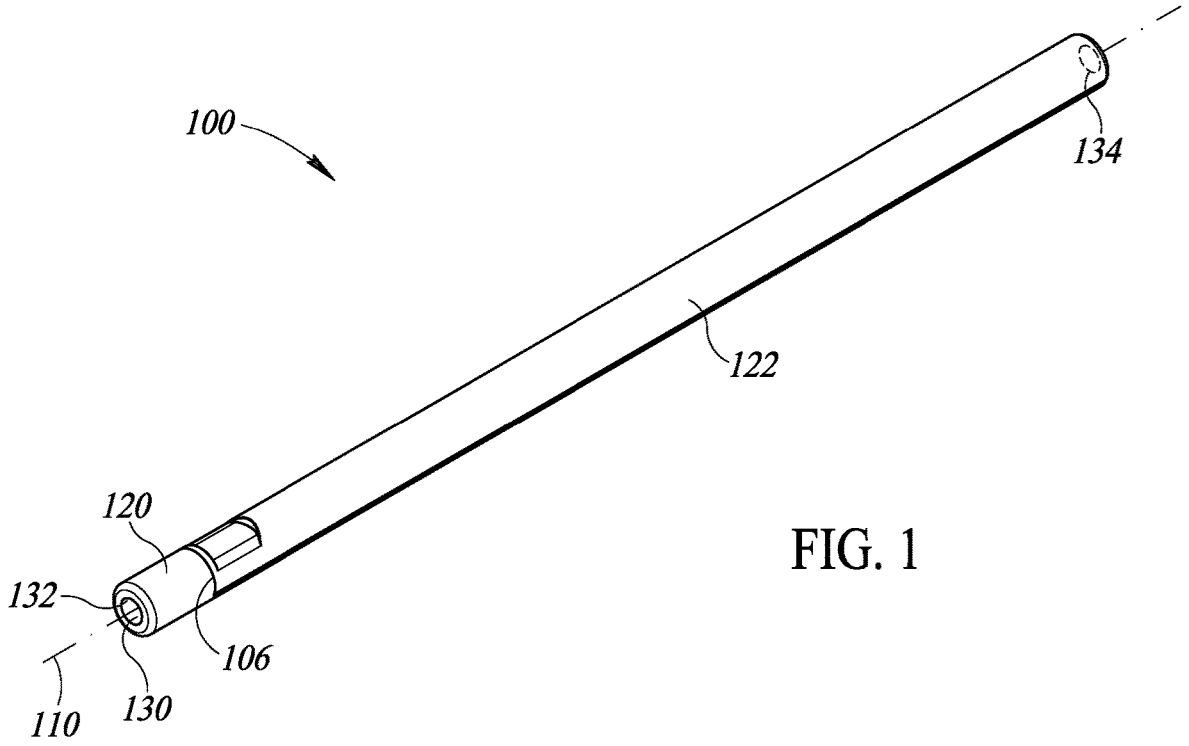
FIG. 1 is a perspective view of a first end of a first embodiment of a drinking straw.
Figure 2:
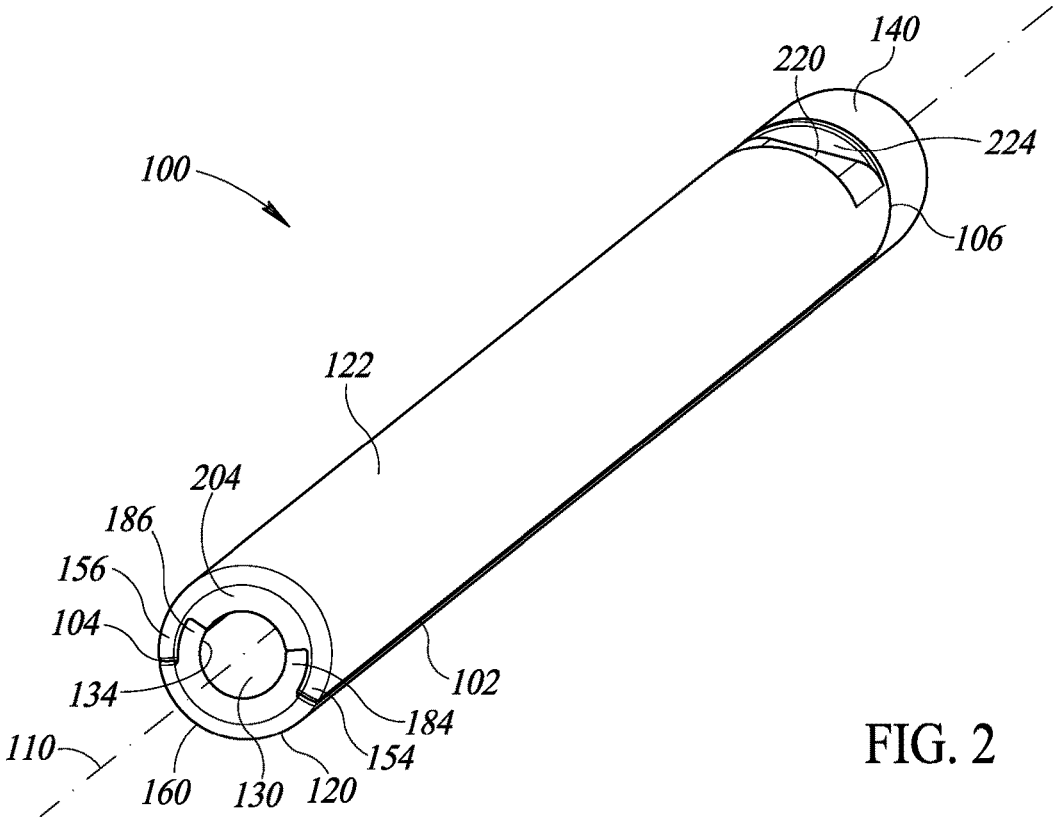
FIG. 2 is a perspective view of a second end of the drinking straw of FIG. 1.

FIGS. 1 and 2 are perspective views of a first embodiment of a drinking straw 100. In the embodiment illustrated, the drinking straw 100 extends along a longitudinal axis 110. The drinking straw 100 includes a first straw portion 120 configured to mate with a second straw portion 122. While the first and second straw portions 120 and 122 have been illustrated as being linear, this is not a requirement and other non-linear shapes may be used to construct the first and second straw portions 120 and 122. In such embodiments, the drinking straw 100 may not necessarily extend along the longitudinal axis 110.

Figure 3:
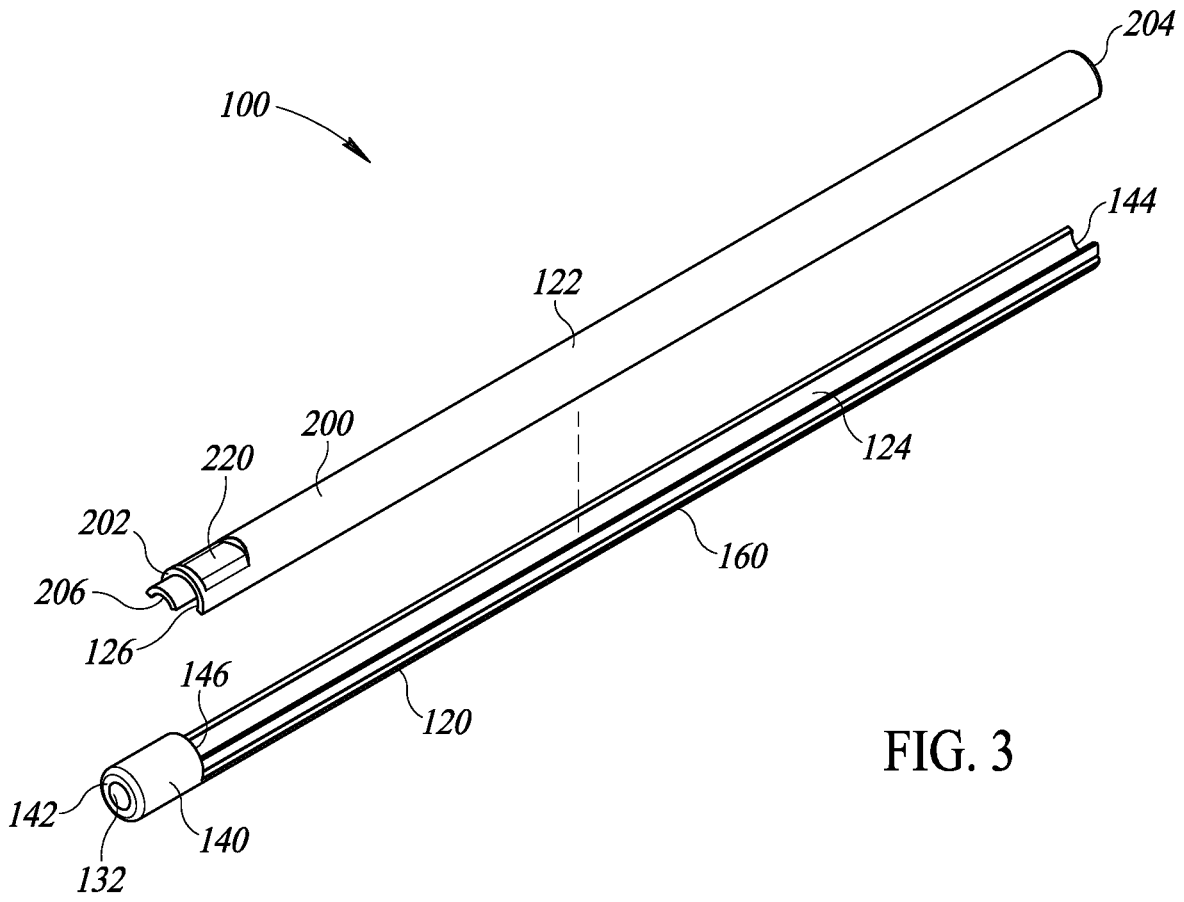
FIG. 3 is an exploded perspective view of the first end of the drinking straw of FIG. 1.
Figure 8:
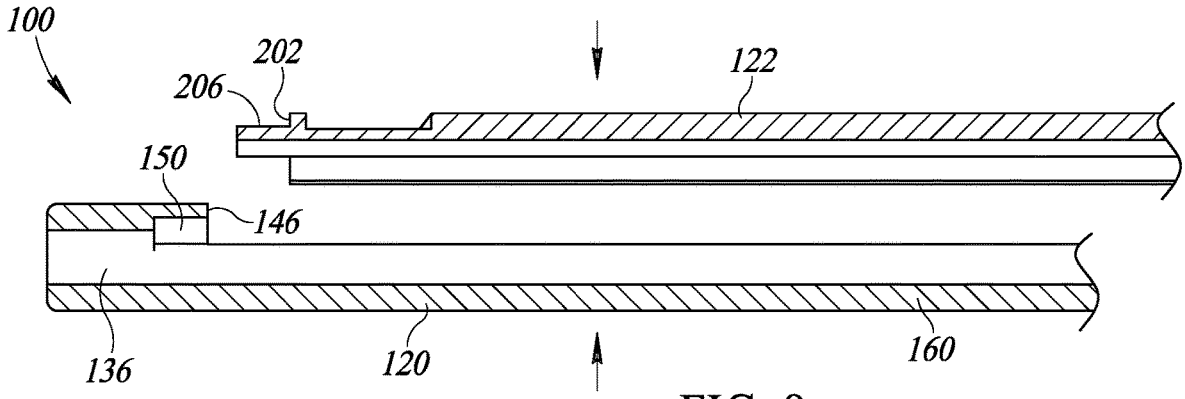
FIG. 8 is an enlarged partial longitudinal cross-sectional view of first and second straw portions of the drinking straw of FIG. 1 being pressed together.

Referring to FIG. 1, the first and second straw portions 120 and 122 are configured to be assembled to form the drinking straw 100 and disassembled, as shown in FIG. 8, for cleaning. When assembled as shown in FIG. 1, the first and second straw portions 120 and 122 define an open-ended internal channel 130 that extends along the longitudinal axis 110 from a first opening 132 to a second opening 134. In the embodiment illustrated, the internal channel 130 has a generally circular cross-sectional shape. However, this is not a requirement. Referring to FIG. 3, when disassembled, interior portions 124 and 126 of the first and second straw portions 120 and 122, respectively, may be cleaned completely by hand (e.g., without tools or brushes) or using dishwasher. Thus, the drinking straw 100 may be reusable.

The first straw portion 120 includes a generally cylindrical mouth portion 140 connected to a body portion 160. The mouth portion 140 is configured to be placed in a user's mouth when the user is drinking from the drinking straw 100. Referring to FIG. 2, a laterally extending seam 106 is defined between the mouth portion 140 and the second straw portion 122 and longitudinally extending seams 102 and 104 are defined between the body portion 160 and the second straw portion 122.

Figure 5:
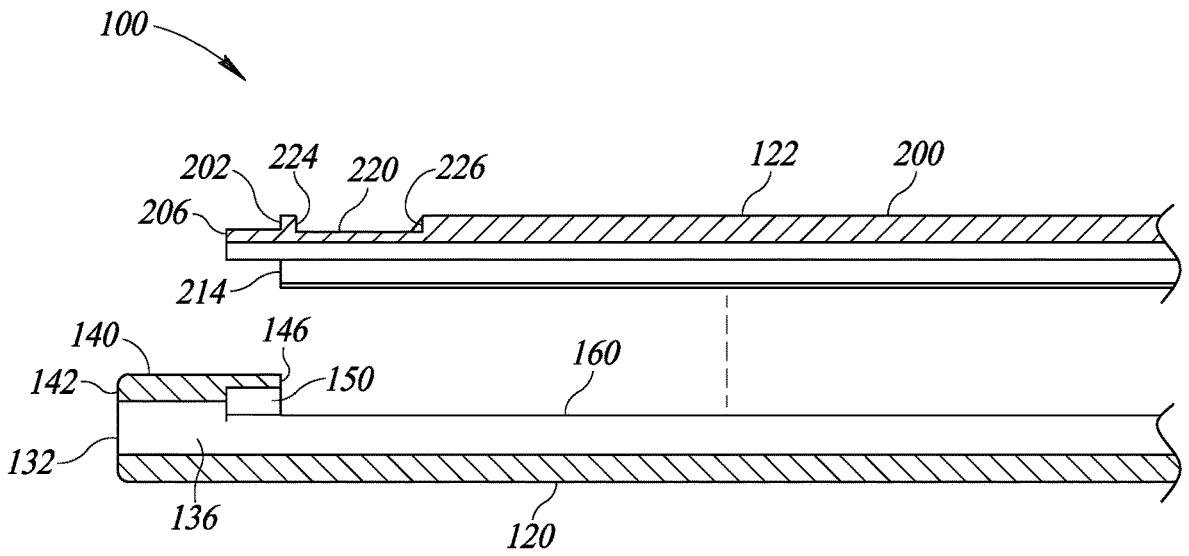
FIG. 5 is an exploded longitudinal cross-sectional view of the drinking straw taken through a line 5-5 of FIG. 4.

Referring to FIG. 5, a first end portion 136 of the internal channel 130 (see FIGS. 1, 2, and 10) extends longitudinally from the first opening 132 and is defined entirely within the mouth portion 140. Because many users chew or bite the end of a straw, the mouth portion 140 helps prevent the first and second straw portions 120 and 122 from being inadvertently disengaged from one another by users who chew or bite on the assembled drinking straw 100. The continuous mouth portion 140 also prevents the lip(s) of the user from being pinched or otherwise injured by one or both of the seams 102 and 104 (see FIG. 2).

Referring to FIG. 3, the first opening 132 is formed in an outwardly facing first end 142 of the mouth portion 140 that is spaced apart from an inwardly facing end surface 146. The inwardly facing end surface 146 extends laterally along a portion of the mouth portion 140 and defines a portion of the laterally extending seam 106. A first portion of the second opening 134 (see FIGS. 1 and 2) is formed in an outwardly facing second end 144 of the first straw portion 120. The outwardly facing first and second ends 142 and 144 are opposite one another.

Figure 7:
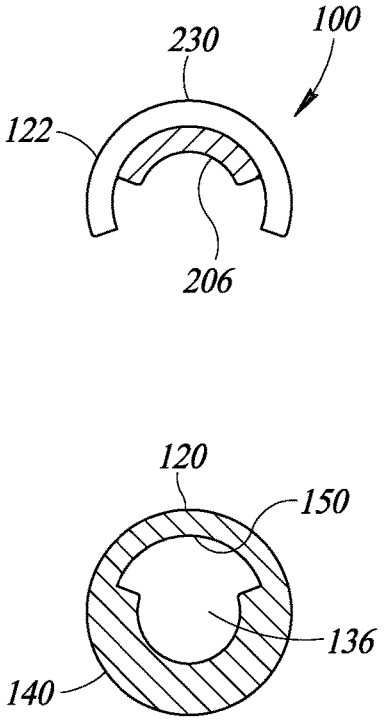
FIG. 7 is an exploded second lateral cross-sectional view of the drinking straw taken through a line 7-7 of FIG. 4.

Referring to FIG. 5, a recess 150 extends longitudinally into the mouth portion 140 from the inwardly facing end surface 146 toward the first end 142. As shown in FIG. 7, the recess 150 may extend laterally and have a generally curved or annular internal lateral shape.

Referring to FIG. 5, the body portion 160 extends from the mouth portion 140 to the outwardly facing second end 144 (see FIG. 3) along a direction substantially parallel with the longitudinal axis 110 (see FIGS. 1 and 2). The inwardly facing end surface 146 may be characterized as marking a division between the mouth portion 140 and the body portion 160. However, as shown, the body portion 160 may be formed with the mouth portion 140 as a single unit. The body portion 160 may have a generally U-shaped cross-sectional shape that opens up toward the second straw portion 122.

Figure 10:
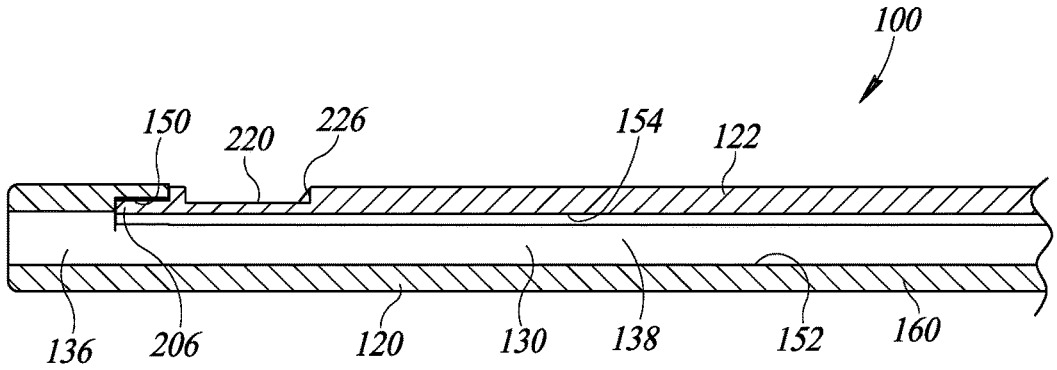
FIG. 10 is an enlarged partial longitudinal cross-sectional view of the assembled drinking straw of FIG. 1.

Referring to FIG. 10, a second end portion 138 of the internal channel 130 is defined between the body portion 160 and the second straw portion 122 when the drinking straw 100 is assembled. Thus, a first portion 152 of the second end portion 138 is defined by the body portion 160 and a second portion 154 of the second end portion 138 is defined by the second straw portion 122.

Figure 6:
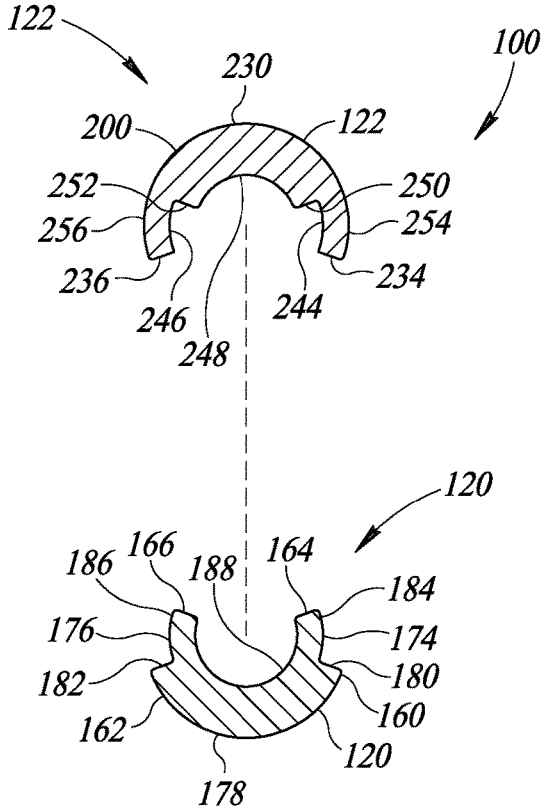
FIG. 6 is an exploded first lateral cross-sectional view of the drinking straw taken through a line 6-6 of FIG. 4.

Referring to FIG. 6, the body portion 160 has a curved sidewall 162 that extends from a longitudinally extending first edge 164 to a longitudinally extending second edge 166. First and second recesses 174 and 176 are formed in an outer surface 178 of the body portion 160 and extend along the longitudinal axis 110 (see FIGS. 1 and 2). The first and second recesses 174 and 176 extend laterally away from the first and second edges 164 and 166, respectively, and terminate at stop walls 180 and 182, respectively. Thus, first and second relieved portions 184 and 186 of the curved sidewall 162 extend laterally away from the stop walls 180 and 182, respectively, and terminate at the first and second edges 164 and 166, respectively. The body portion 160 has an inner surface 188 that defines the first portion 152 (see FIG. 10) of the second end portion 138 (see FIG. 10) of the internal channel 130 (see FIGS. 1, 2, and 10). In the embodiment illustrated, the inner surface 188 has a generally U-shaped cross-sectional shape.

Referring to FIG. 3, the second straw portion 122 includes a body portion 200 configured to be positioned adjacent the body portion 160 of the first straw portion 120. The body portion 200 has a first end portion 202 opposite a second end portion 204. A second portion of the second opening 134 (see FIGS. 1 and 2) is formed in the second end portion 204 of the second straw portion 122.

A projection 206 extends outwardly from the first end portion 202 in a direction substantially parallel with the longitudinal axis 110 (see FIGS. 1 and 2). As shown in FIG. 7, the projection 206 may extend laterally and have a generally curved or annular outer lateral shape. Referring to FIG. 5, the projection 206 is configured to be received inside the recess 150 when the first and second straw portions 120 and 122 are assembled to form the drinking straw 100. The first end portion 202 has an outwardly facing surface 214 configured to abut the inwardly facing end surface 146 when the drinking straw 100 is assembled.

Figure 9:
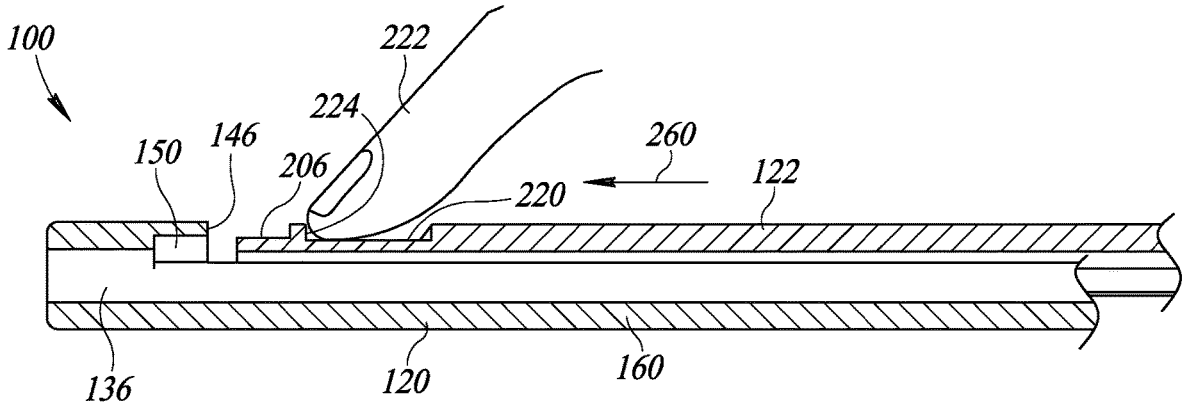
FIG. 9 is an enlarged partial longitudinal cross-sectional view of the second straw portion being slid along the first straw portion of the drinking straw of FIG. 1.

Optionally, the body portion 200 may have an outer recess 220 formed therein that may be configured to receive a user's finger 222 (see FIG. 9). The outer recess 220 may extend from a first stop wall 224 to a second stop wall 226. The first stop wall 224 is nearer the first end portion 202 than the second stop wall 226.

Referring to FIG. 6, the body portion 200 has a curved sidewall 230 that extends from a longitudinally extending first edge 234 to a longitudinally extending second edge 236. First and second recesses 244 and 246 are formed in an inner surface 248 of the body portion 200 and extend along the longitudinal axis 110 (see FIGS. 1 and 2). The first and second recesses 244 and 246 extend laterally away from the first and second edges 234 and 236, respectively, and terminate at stop walls 250 and 252, respectively. Thus, first and second relieved portions 254 and 256 of the curved sidewall 230 extend laterally away from the stop walls 250 and 252, respectively, and terminate at the first and second edges 234 and 236, respectively. The inner surface 248 defines the second portion 154 (see FIG. 10) of the second end portion 138 (see FIG. 10) of the internal channel 130 (see FIGS. 1, 2, and 10). In the embodiment illustrated, the inner surface 248 has a generally curved or U-shaped cross-sectional shape.

The first and second recesses 244 and 246 of the second straw portion 122 are configured to receive the first and second relieved portions 184 and 186 of the first straw portion 120. At the same time, the first and second recesses 174 and 176 of the first straw portion 120 are configured to receive the first and second relieved portions 254 and 256 of the second straw portion 122. Thus, referring to FIG. 2, the seam 102 is defined between the first relieved portions 184 and 254 and the seam 104 is defined between the second relieved portions 186 and 256. Additionally, referring to FIG. 10, as mentioned above, the recess 150 is configured to receive the projection 206. In this manner, the first and second straw portions 120 and 122 are coupled together in a sealed manner and a fluid passing through the internal channel 130 will not leak out through the seams 102 and 104 (see FIG. 2). Referring to FIG. 6, when so assembled, the first and second edges 164 and 166 may be positioned immediately adjacent the stop walls 250 and 252, respectively, and the first and second edges 234 and 236 may be positioned immediately adjacent the stop walls 180 and 182, respectively.

FIGS. 8-10 illustrate how the drinking straw 100 may be assembled. Referring to FIG. 8, the second straw portion 122 is positioned alongside the first straw portion 120 with the projection 206 spaced apart longitudinally from the inwardly facing end surface 146. Then, referring to FIG. 6, the first and second straw portions 120 and 122 are pressed together until the first and second relieved portions 254 and 256 of the second straw portion 122 snap into the first and second recesses 174 and 176, respectively, of the first straw portion 120, and the first and second relieved portions 184 and 186 of the first straw portion 120 snap into the first and second recesses 244 and 246, respectively, of the second straw portion 122. Alternatively, referring to FIG. 3, the first end portion 202 of the second straw portion 122 may be positioned alongside the second end 144 of the first straw portion 120. Referring to FIG. 6, the first and second relieved portions 254 and 256 of the second straw portion 122 are aligned with the first and second recesses 174 and 176, respectively, of the first straw portion 120, and the first and second relieved portions 184 and 186 of the first straw portion 120 are aligned with the first and second recesses 244 and 246, respectively, of the second straw portion 122. Then, referring to FIG. 3, the first end portion 202 of the second straw portion 122 is slid onto the second end 144 of the first straw portion 120. In other words, the first and second relieved portions 254 and 256 are slid into the first and second recesses 174 and 176, respectively, and the first and second relieved portions 184 and 186 are slid into the first and second recesses 244 and 246, respectively.

Next, referring to FIG. 9, the second straw portion 122 is slid along the body portion 160 of the first straw portion 120 toward the mouth portion 140 (in a direction identified by an arrow 260) until the projection 206 is received inside the recess 150 as shown in FIG. 10. Thus, the recess 150 and the projection 206 may be characterized as forming a tongue and groove style connection. Referring to FIG. 9, the second straw portion 122 may be slid by a user who presses against the first stop wall 224 defined by the outer recess 220. For example, the user may place the user's finger 222 in the outer recess 220 and press therewith against the first stop wall 224. Pressing against the first stop wall 224 slides the second straw portion 122 toward the mouth portion 140.

Figure 4:
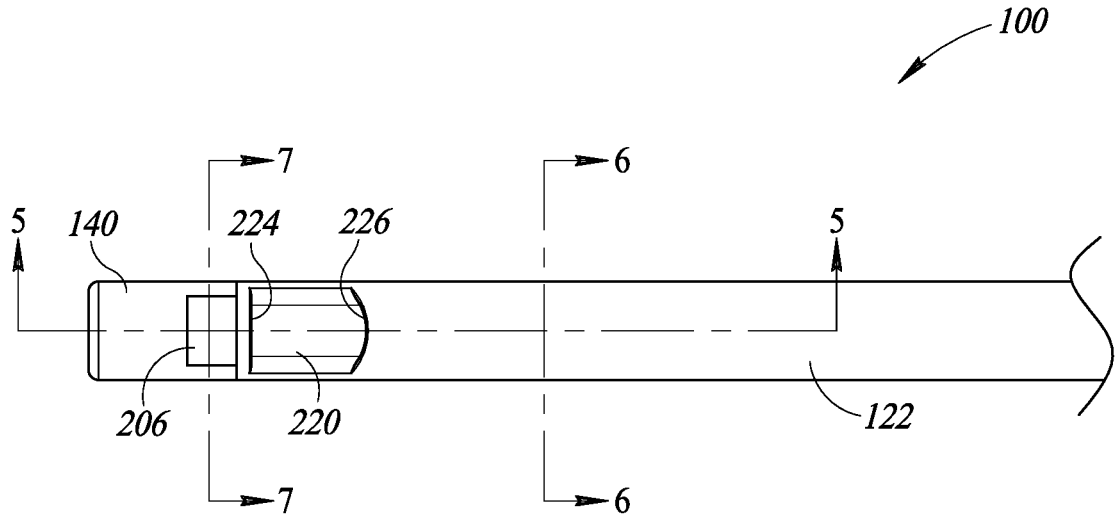
FIG. 4 is an enlarged partial top view of the exploded view of FIG. 3.

The drinking straw 100 may be disassembled by sliding the second straw portion 122 along the body portion 160 of the first straw portion 120 in a direction opposite the direction identified by the arrow 260. The second straw portion 122 may be slid until it disengages from the body portion 160 of the first straw portion 120. Alternatively, the second straw portion 122 may be slid until the projection 206 disengages from the recess 150. Then, the second straw portion 122 and the body portion 160 of the first straw portion 120 may be pulled apart laterally. The second straw portion 122 may be slid by the user pressing against the second stop wall 226 (see FIGS. 4, 5, and 10) defined by the outer recess 220.

Figure 11:
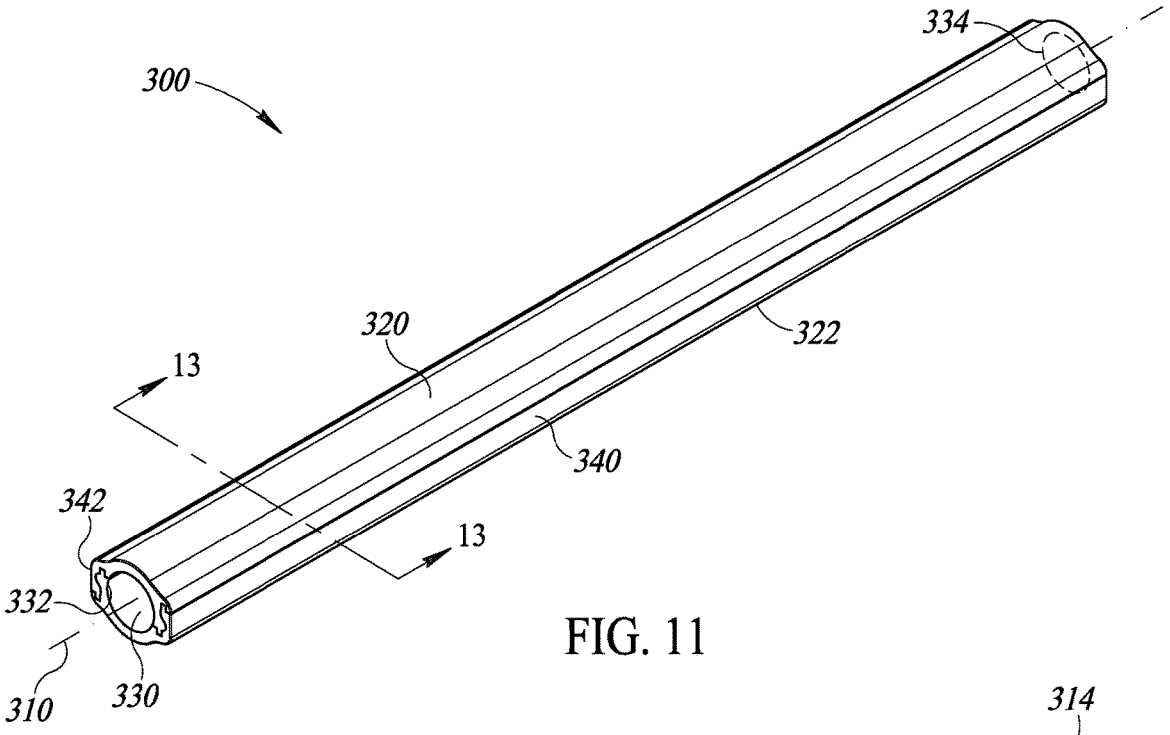
FIG. 11 is a perspective view of a first end of a second embodiment of a drinking straw.

FIG. 11 is a perspective view of a second embodiment of a drinking straw 300. In the embodiment illustrated, the drinking straw 300 extends along a longitudinal axis 310. The drinking straw 300 includes interlocking first and second straw portions 320 and 322. While the first and second straw portions 320 and 322 have been illustrated as being linear, this is not a requirement and other non-linear shapes may be used to construct the first and second straw portions 320 and 322. In such embodiments, the drinking straw 300 may not necessarily extend along the longitudinal axis 310.

Figure 12:
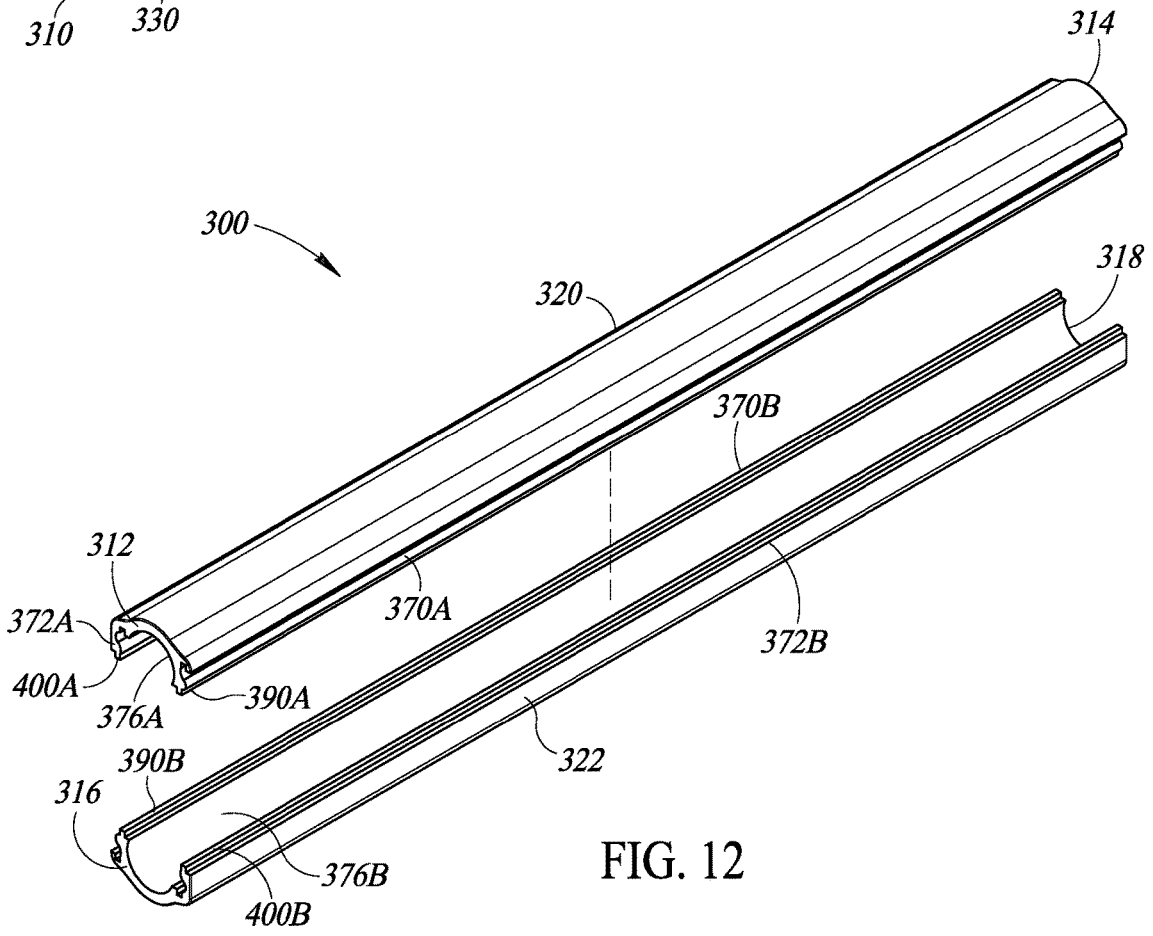
FIG. 12 is an exploded perspective view of the first end of the drinking straw of FIG. 11.

Referring to FIG. 12, the first straw portion 320 has a first end 312 opposite a second end 314. The second straw portion 322 has a first end 316 opposite a second end 318. When the first and second straw portions 320 and 322 are assembled together (see FIGS. 11 and 13), the first end 312 of the first straw portion 320 is adjacent to the first end 316 of the second straw portion 322 and the second end 314 of the first straw portion 320 is adjacent to the second end 318 of the second straw portion 322.

Referring to FIG. 11, when the first and second straw portions 320 and 322 are assembled together, the first and second straw portions 320 and 322 define an open-ended internal channel 330 that extends from a first opening 332 to a second opening 334. While in the embodiment illustrated, the internal channel 330 has a generally circular cross-sectional shape, this is not a requirement. In the embodiment illustrated, the internal channel 330 extends along the longitudinal axis 310. However, as explained above, this is not a requirement. Referring to FIG. 12, the first opening 332 (see FIG. 11) is defined by the first ends 312 and 316 of the first and second straw portions 320 and 322, respectively. Similarly, the second opening 334 (see FIG. 11) is defined by the second ends 314 and 318 of the first and second straw portions 320 and 322, respectively.

Figure 13:
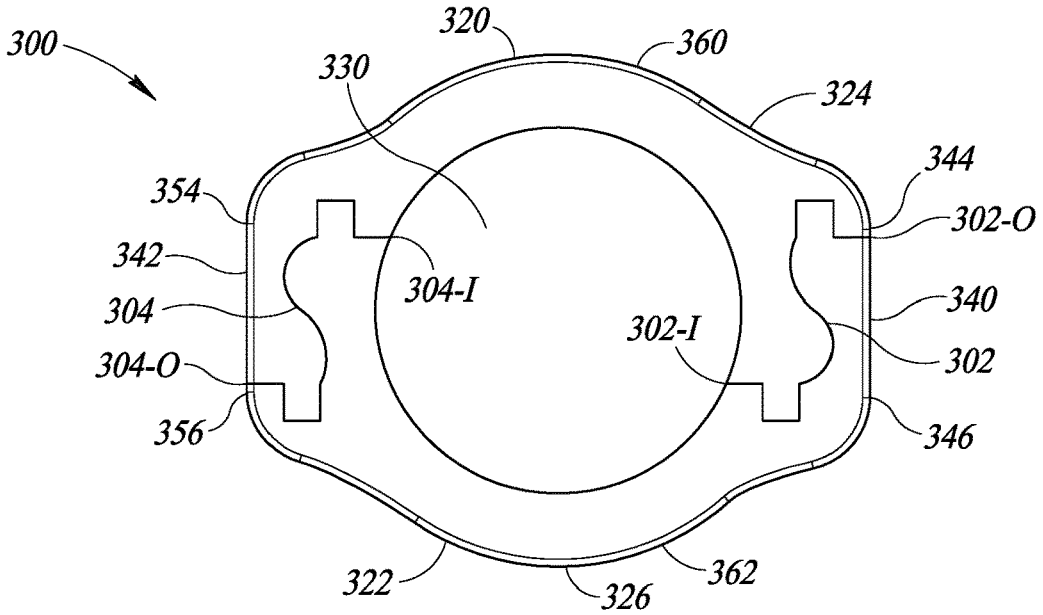
FIG. 13 is a lateral cross-sectional view of the drinking straw taken through a line 13-13 of FIG. 11.

Referring to FIG. 13, longitudinally extending seams 302 and 304 are defined between the first and second straw portions 320 and 322. In the embodiment illustrated, the seams 302 and 304 extend the entire length of the drinking straw 300.

The first and second straw portions 320 and 322 have first and second outer surfaces 324 and 326, respectively. The drinking straw 300 has a longitudinally extending first planar outer surface 340 opposite a longitudinally extending second planar outer surface 342. The first and second planar outer surfaces 340 and 342 are substantially parallel with one another. The first planar outer surface 340 has a first end 344 opposite a second end 346. The second planar outer surface 342 has a first end 354 opposite a second end 356. The first outer surface 324 includes a first curved outer surface 360 that extends from the first end 344 to the first end 354. The second outer surface 326 includes a second curved outer surface 362 that extends from the second end 346 to the second end 356.

In the embodiment illustrated, all or a majority of the second planar outer surface 342 is formed in the first outer surface 324 and all or a majority of the first planar outer surface 340 is formed in the second outer surface 326. An outer end 302-O of the seam 302 is positioned at or near the first end 344 of the first planar outer surface 340. An inner end 302-I of the seam 302 is positioned in the internal channel 330. An outer end 304-O of the seam 304 is positioned at or near the second end 356 of the second planar outer surface 342. An inner end 304-I of the seam 304 is positioned in the internal channel 330. As shown in FIG. 13, the seams 302 and 304 may each have a generally S-shaped cross-sectional shape.

Figure 14:
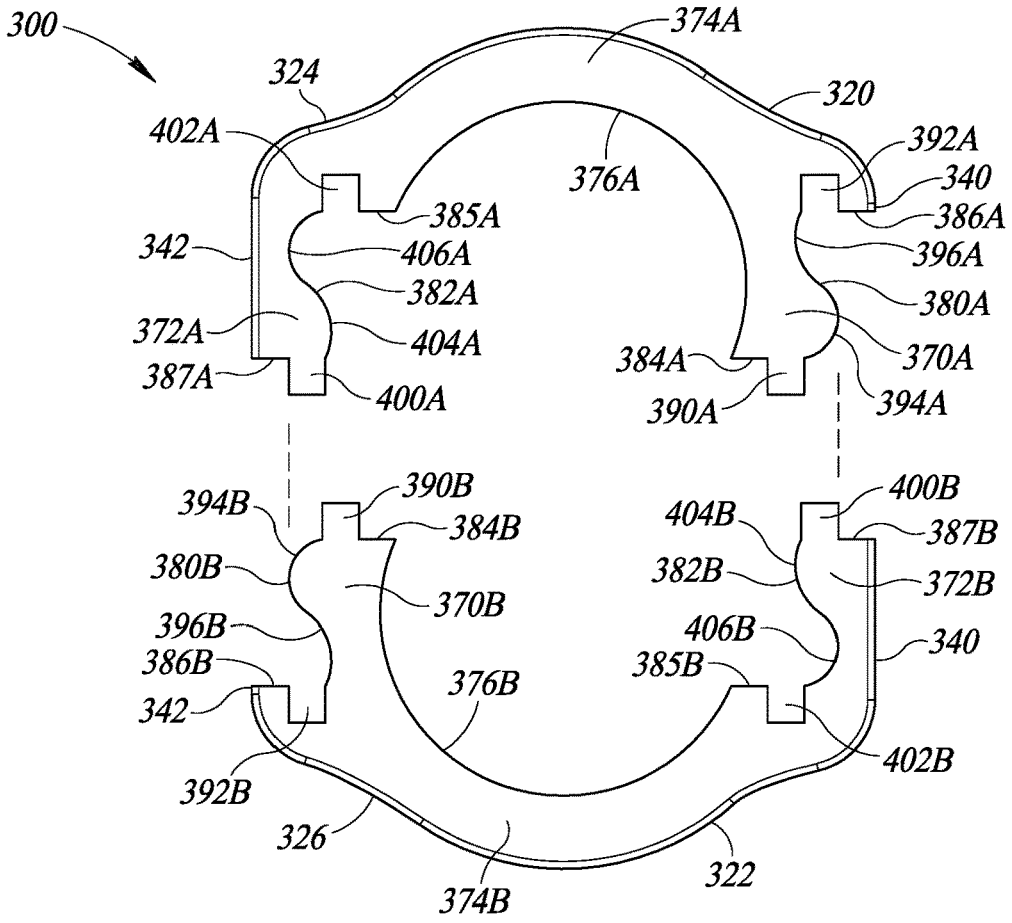
FIG. 14 is an exploded view of the lateral cross-sectional view of FIG. 13.

FIG. 14 is an exploded end view of the first and second straw portions 320 and 322. As shown in FIG. 14, the first and second straw portions 320 and 322 may be identical to one another. For example, the first straw portion 320 is identical to the second straw portion 322 rotated 180 degrees. Similarly, the second straw portion 322 is identical to the first straw portion 320 rotated 180 degrees. Therefore, a single tool (e.g., a die, a mold, etc.) may be used to form both the first and second straw portions 320 and 322. For example, the first and second straw portions 320 and 322 may be formed by extruding them through the same die or identical dies. Similarly, the first and second straw portions 320 and 322 may be formed by molding them using the same mold or identical molds.

The first straw portion 320 may be substantially U-shaped having spaced apart first and second legs 370A and 372A that extend outwardly from a base 374A. The first straw portion 320 has an interior surface 376A that defines a portion of the internal channel 330 (see FIGS. 11 and 13). An outwardly facing first surface 380A extends along the first leg 370A from the first outer surface 324 to the interior surface 376A. The first surface 380A defines a portion of the seam 302 (see FIG. 13) and extends between the outer and inner ends 302-O and 302-I (see FIG. 13). An inwardly facing second surface 382A extends along the second leg 372A from the first outer surface 324 to the interior surface 376A. The second surface 382A defines a portion of the seam 304 (see FIG. 13) and extends between the outer and inner ends 304-O and 304-I (see FIG. 13).

Similarly, the second straw portion 322 may be substantially U-shaped having spaced apart first and second legs 370B and 372B that extend outwardly from a base 374B. The second straw portion 322 has an interior surface 376B that defines a portion of the internal channel 330 (see FIGS. 11 and 13). An outwardly facing first surface 380B extends along the first leg 370B from the second outer surface 326 to the interior surface 376B. The first surface 380B is configured to mate with the second surface 382A and define the seam 304 (see FIG. 13) therebetween. Thus, the first surface 380B defines a portion of the seam 304 (see FIG. 13) and extends between the outer and inner ends 304-O and 304-I (see FIG. 13). An inwardly facing second surface 382B extends along the second leg 372B from the second outer surface 326 to the interior surface 376B. The second surface 382B is configured to mate with the first surface 380A and define the seam 302 (see FIG. 13) therebetween. Thus, the second surface 382B defines a portion of the seam 302 (see FIG. 13) and extends between the outer and inner ends 302-O and 3024-I (see FIG. 13).

The first leg 370A of the first straw portion 320 includes a longitudinally extending rail or projection 390A and a longitudinally extending recess 392A. The projection 390A is offset laterally toward the internal channel 330 (see FIGS. 11 and 13) from the recess 392A. Thus, the projection 390A is nearer to the interior surface 376A than the recess 392A. The first surface 380A includes an inner stop portion 384A that extends laterally between the projection 390A and the interior surface 376A. The first surface 380A includes an outer stop portion 386A that extends laterally between the recess 392A and the first outer surface 324. The projection 390A extends toward the second leg 372B along a first direction substantially parallel with the first planar outer surface 340 and the recess 392A extends away from the second leg 372B along a second direction substantially parallel with the first planar outer surface 340. Thus, the projection 390A and the recess 392A extend in opposite directions. In the embodiment illustrated, the first leg 370A terminates with the projection 390A.

The first surface 380A is contoured to define a key 394A and an optional keyway 396A. In the embodiment illustrated, the key 394A is nearer to the projection 390A than the recess 392A and the optional keyway 396A is nearer to the recess 392A than the projection 390A. The key 394A may extend outwardly toward the first planar outer surface 340 in a direction substantially orthogonal to the first planar outer surface 340. The optional keyway 396A may extend inwardly away from the first planar outer surface 340 in a direction substantially orthogonal to the first planar outer surface 340. Thus, the key 394A and the optional keyway 396A extend in opposite directions.

The second leg 372A of the first straw portion 320 includes a longitudinally extending rail or projection 400A and a longitudinally extending recess 402A. The recess 402A is offset laterally toward the internal channel 330 (see FIGS. 11 and 13) from the projection 400A. Thus, the recess 402A is nearer to the interior surface 376A than the projection 400A. The second surface 382A includes an inner stop portion 385A that extends laterally between the recess 402A and the interior surface 376A. The second surface 382A includes an outer stop portion 387A that extends laterally between the projection 400A and the first outer surface 324. The projection 400A extends toward the first leg 370B along a third direction substantially parallel with the second planar outer surface 342 and the recess 402A extends away from the first leg 370B along a fourth direction substantially parallel with the second planar outer surface 342. Thus, the projection 400A and the recess 402A extend in opposite directions. In the embodiment illustrated, the second leg 372A terminates with the projection 400A.

The second surface 382A is contoured to define an optional key 404A and a keyway 406A. In the embodiment illustrated, the optional key 404A is nearer the projection 400A than the recess 402A and the keyway 406A is nearer the recess 402A than the projection 400A. The keyway 406A may extend outwardly toward the second planar outer surface 342 in a direction substantially orthogonal to the second planar outer surface 342. The optional key 404A may extend inwardly away from the second planar outer surface 342 in a direction substantially orthogonal to the second planar outer surface 342. Thus, the keyway 406A and the optional key 404A extend in opposite directions.

The first leg 370B of the second straw portion 322 includes a longitudinally extending rail or projection 390B and a longitudinally extending recess 392B. The projection 390B is offset laterally toward the internal channel 330 (see FIGS. 11 and 13) from the recess 392B. Thus, the projection 390B is nearer to the interior surface 376B than the recess 392B. The first surface 380B includes an inner stop portion 384B that extends laterally between the projection 390B and the interior surface 376B. The first surface 380B includes an outer stop portion 386B that extends laterally between the recess 392B and the second outer surface 326. The projection 390B extends toward the second leg 372A along a first direction substantially parallel with the second planar outer surface 342 and the recess 392B extends away from the second leg 372A along a second direction substantially parallel with the second planar outer surface 342. Thus, the projection 390B and the recess 392B extend in opposite directions. In the embodiment illustrated, the first leg 370B terminates with the projection 390B.

The first surface 380B is contoured to define a key 394B and an optional keyway 396B. In the embodiment illustrated, the key 394B is nearer to the projection 390B than the recess 392B and the optional keyway 396B is nearer to the recess 392B than the projection 390B. The key 394B may extend outwardly toward the second planar outer surface 342 in a direction substantially orthogonal to the second planar outer surface 342. The optional keyway 396B may extend inwardly away from the second planar outer surface 342 in a direction substantially orthogonal to the second planar outer surface 342. Thus, the key 394B and the optional keyway 396B extend in opposite directions.

The second leg 372B of the second straw portion 322 includes a longitudinally extending rail or projection 400B and a longitudinally extending recess 402B. The recess 402B is offset laterally toward the internal channel 330 (see FIGS. 11 and 13) from the projection 400B. Thus, the recess 402B is nearer to the interior surface 376B than the projection 400B. The second surface 382B includes an inner stop portion 385B that extends laterally between the recess 402B and the interior surface 376B. The second surface 382B includes an outer stop portion 387B that extends laterally between the projection 400B and the second outer surface 326. The projection 400B extends toward the first leg 370A along a third direction substantially parallel with the first planar outer surface 340 and the recess 402B extends away from the first leg 370A along a fourth direction substantially parallel with the first planar outer surface 340. Thus, the projection 400B and the recess 402B extend in opposite directions. In the embodiment illustrated, the second leg 372B terminates with the projection 400B.

The second surface 382B is contoured to define an optional key 404B and a keyway 406B. In the embodiment illustrated, the optional key 404B is nearer the projection 400B than the recess 402B and the keyway 406B is nearer the recess 402B than the projection 400B. The keyway 406B may extend outwardly toward the first planar outer surface 340 in a direction substantially orthogonal to the first planar outer surface 340. The optional key 404B may extend inwardly away from the first planar outer surface 340 in a direction substantially orthogonal to the first planar outer surface 340. Thus, the keyway 406B and the optional key 404B extend in opposite directions.

The key 394A may be larger than the optional key 4046. In such embodiments, the keyway 406B is larger than the optional keyway 396A. The key 394B may be larger than the optional key 404A. In such embodiments, the keyway 406A is larger than the optional keyway 3966.

The drinking straw 300 may be assembled by positioning the first straw portion 320 alongside the second straw portion 322 with the first leg 370A aligned with the second leg 372B and the second leg 372A aligned with the first leg 370B. Then, the first and second straw portions 320 and 322 are pressed together which causes the key 394A to slide passed the optional key 404B and enter the keyway 406B. At the same time, the optional key 404B slides passed the key 394A and may optionally enter the optional keyway 396A. The first leg 370A may deflect into the internal channel 330 and/or the second leg 372B may deflect outwardly to allow the key 394A to slide passed the optional key 404B and the optional key 404B to slide passed the key 394A. Simultaneously, the key 394B slides passed the optional key 404A and enters the keyway 406A. The optional key 404A slides passed the key 394B and may optionally enter the optional keyway 3966. The second leg 372A may deflect outwardly and/or the first leg 370B may deflect into the internal channel 330 to allow the optional key 404A to slide passed the key 394B and the key 394B to slide passed the optional key 404A. The first and second straw portions 320 and 322 are pressed together until the projection 390A is positioned inside the recess 402B, the projection 400B is positioned inside the recess 392A, the projection 400A is positioned inside the recess 392B, and the projection 390B is positioned inside the recess 402A.

Alternatively, referring to FIG. 12, the drinking straw 300 may be assembled by positioning the first end 312 of the first straw portion 320 alongside the second end 318 of the second straw portion 322 with the first leg 370A aligned with the second leg 372B and the second leg 372A aligned with the first leg 370B. Then, the first straw portion 320 is slid into engagement with the second straw portion 322. Specifically, the key 394A is slid into the keyway 406B and the key 394B is slid into the keyway 406A. At the same time, the projections 390A and 400A slide into the recesses 402B and 392B, respectively, and the projections 390B and 400B slide into the recesses 402A and 392A, respectively. The first straw portion 320 is slid along the second straw portion 322 until the first end 312 of the first straw portion 320 is aligned with the first end 316 of the second straw portion 322.

The drinking straw 300 may be disassembled by sliding the first straw portion 320 along the second straw portion 322 until the first end 312 of the first straw portion 320 clears the second end 318 of the second straw portion 322 and the first straw portion 320 is completely disengaged from the second straw portion 322.

Each of the drinking straws 100 and 300 splits into two separate straw portions (or pieces), which exposes the interior of the drinking straw. This allows the user to wash the inside of the drinking straws 100 and 300 by hand or using a dishwasher. Slide or snap features securely hold the two separate straw portions together and allow the drinking straws 100 and 300 to be disassembled.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

The invention claimed is:

1. A drinking straw comprising:

a first straw portion having first and second legs extending outwardly from a first base portion, the first straw portion having a first internal surface, the first leg having a first key, the second leg having a first keyway; and a second straw portion configured to be removably attachable to the first straw portion, the second straw portion having a second internal surface, the first and second internal surfaces defining an open-ended internal channel when the first and second straw portions are attached together, the second straw portion having third and fourth legs extending outwardly from a second base portion, the third leg having a second key, the fourth leg having a second keyway, the first and second straw portions being attachable together by placing the first key inside the second keyway and the second key inside the first keyway.

2. The drinking straw of claim 1, further comprising:

a longitudinal axis, the first and second straw portions being attachable together by applying lateral pressure to the first and second straw portions causing them to snap together, which causes the first leg to slide laterally along the fourth leg until the first key is positioned inside the second keyway and causes the third leg to slide laterally along the second leg until the second key is positioned inside the first keyway.

3. The drinking straw of claim 1, wherein the first leg has a third keyway, the second leg has a third key, the third leg having a fourth keyway, the fourth leg having a fourth key, and the first and second straw portions being attachable together by placing the third key inside the fourth keyway and the fourth key inside the third keyway.

4. The drinking straw of claim 3, wherein the first leg has a first projection and a first recess, the second leg has a second projection and a second recess, the third leg has a third projection and a third recess, the fourth leg has a fourth projection and a fourth recess, and when the first and second straw portions are attached together, the first projection is positioned inside the fourth recess, the second projection is positioned inside the third recess, the third projection is positioned inside the second recess, and the fourth projection is positioned inside the first recess.

5. The drinking straw of claim 1, wherein the first leg has a first projection and a first recess, the second leg has a second projection and a second recess, the third leg has a third projection and a third recess, the fourth leg has a fourth projection and a fourth recess, and when the first and second straw portions are attached together, the first projection is positioned inside the fourth recess, the second projection is positioned inside the third recess, the third projection is positioned inside the second recess, and the fourth projection is positioned inside the first recess.

6. The drinking straw of claim 5, further comprising:

a first planar outer surface portion, the first and fourth projections being parallel with the first planar outer surface portion; and a second planar outer surface portion opposite and parallel with the first planar outer surface portion, the second and third projections being parallel with the second planar outer surface portion.

7. The drinking straw of claim 1, further comprising:

a first planar outer surface portion, the first key extending outwardly in a first direction orthogonal to the first planar outer surface portion, the second keyway extending outwardly in the first direction; and a second planar outer surface portion opposite and parallel with the first planar outer surface portion, the second key extending outwardly in a second direction orthogonal to the second planar outer surface portion, the first keyway extending outwardly in the second direction, the second direction being opposite the first direction.

8. The drinking straw of claim 1, wherein the open-ended internal channel has a circular cross-sectional shape.

9. The drinking straw of claim 1, wherein the first and second straw portions are each linear and extend along a longitudinal axis.

10. The drinking straw of claim 1, wherein the first and second straw portions are each extruded through a common die or identical dies.

11. The drinking straw of claim 1, wherein the first and second straw portions are each molded in a common mold or identical molds.

* * * * *